US012636753B2

(12) United States Patent
Wakamatsu

(10) Patent No.: US 12,636,753 B2
(45) Date of Patent: May 26, 2026

(54) GRINDING APPARATUS

(71) Applicant: Tokyo Electron Limited, Tokyo (JP)

(72) Inventor: Takayoshi Wakamatsu, Kumamoto (JP)

(73) Assignee: Tokyo Electron Limited, Tokyo (JP)

( * ) Notice: Subject to any disclaimer, the term of this patent is extended or adjusted under 35 U.S.C. 154(b) by 875 days.

(21) Appl. No.: 17/905,509

(22) PCT Filed: Feb. 24, 2021

(86) PCT No.: PCT/JP2021/006766
§ 371 (c)(1),
(2) Date: Sep. 2, 2022

(87) PCT Pub. No.: WO2021/177090
PCT Pub. Date: Sep. 10, 2021

(65) Prior Publication Data

US 2023/0330811 A1 Oct. 19, 2023

(30) Foreign Application Priority Data

Mar. 6, 2020 (JP) ..... 2020-038617
Nov. 26, 2020 (JP) ..... 2020-196353

(51) Int. Cl.
*B24B 55/06* (2006.01)
*B24B 7/04* (2006.01)

(52) U.S. Cl.
CPC ..... *B24B 55/06* (2013.01); *B24B 7/04* (2013.01)

(58) Field of Classification Search
CPC ..... B23Q 11/06; B23Q 11/08; B23Q 11/0816; B23Q 11/0825; B23Q 11/0858;
(Continued)

(56) References Cited

U.S. PATENT DOCUMENTS 6,568,885 B2 * 5/2003 Green ..... B23Q 11/0891 52/64
2009/0042488 A1 * 2/2009 Sekiya ..... B24B 7/228 451/41

(Continued)

FOREIGN PATENT DOCUMENTS

CN 208938927 U 6/2019
JP 2012121085 A * 6/2012
JP 2019185645 A * 10/2019

OTHER PUBLICATIONS

Machine Translation—JP2019185645 (Year: 2019).*

(Continued)

*Primary Examiner* — Brian D Keller
*Assistant Examiner* — Alberto Saenz
(74) *Attorney, Agent, or Firm* — Shih IP Law Group, PLLC.

(57) ABSTRACT

A grinding apparatus includes a rotary table, multiple chuck, a rotational driving unit, a grinding position cover, a cleaning unit and an attachment/detachment position cover. The horizontal rotary table is configured to be rotated around a vertical rotation center line. The multiple chucks are arranged at an equal distance therebetween around the rotation center line of the rotary table. The rotational driving unit moves the chuck between an attachment/detachment position and a grinding position. The grinding position cover covers the grinding position from above and from a side. The cleaning unit is configured to supply a cleaning liquid to the chuck or the substrate at the attachment/detachment position. The attachment/detachment position cover covers the attachment/detachment position from above and from a side. The attachment/detachment position cover is provided with a transfer opening for the substrate in a side surface thereof, and accommodates therein the chuck and the cleaning unit.

17 Claims, 9 Drawing Sheets

(58) Field of Classification Search
CPC . B23Q 11/0866; B23Q 11/0891; B24B 55/00; B24B 55/04; B24B 55/06; B24B 55/12; B24B 7/04
USPC ..... 451/178, 451, 452, 453, 454, 455, 456, 451/457
See application file for complete search history.

(56) References Cited

U.S. PATENT DOCUMENTS

2012/0234356 A1* 9/2012 Nishi ..... H01L 21/02052 134/21
2017/0287704 A1* 10/2017 Amano ..... H01L 21/67253
2018/0200764 A1* 7/2018 Fukui ..... B08B 5/023

OTHER PUBLICATIONS

JP 2012121085—Machine Translation (Year: 2012).*
International Search Report of PCT/JP2021/ 006766 dated Apr. 13, 2021.

* cited by examiner

GRINDING APPARATUS

CROSS-REFERENCE TO RELATED APPLICATIONS

This Application is a U.S. national phase application under 35 U.S.C. § 371 of PCT Application No. PCT/JP2021/006766 filed on Feb. 24, 2021, which claims the benefit of Japanese Patent Application Nos. 2020-038617 and 2020-196353 filed on Mar. 6, 2020 and Nov. 26, 2020, respectively, the entire disclosures of which are incorporated herein by reference.

TECHNICAL FIELD

The various aspects and embodiments described herein pertain generally to a grinding apparatus.

BACKGROUND

A processing apparatus described in Patent Document 1 is equipped with a first transfer unit, a position adjusting mechanism, a second transfer unit, a turntable, a chuck table, a processing unit, and a cleaning mechanism. The first transfer unit transfers a substrate from a cassette to the position adjusting mechanism. The position adjusting mechanism adjusts a position of the substrate. The second transfer unit transfers the substrate from the position adjusting mechanism to the chuck table on the turntable. If the chuck table attracts and holds the substrate, the turntable is spun to place the substrate below the processing unit. The processing unit grinds the substrate with a grinding wheel. The second transfer unit is turned while attracting and holding the substrate after being ground, and transfers the substrate to the cleaning mechanism. The cleaning mechanism cleans the substrate after being ground. The first transfer unit transfers the cleaned substrate from the cleaning mechanism to the cassette.

PRIOR ART DOCUMENT

Patent Document 1: Japanese Patent Laid-open Publication No. 2019-185645

DISCLOSURE OF THE INVENTION

Problems to be Solved by the Invention

Exemplary embodiments provide a technique enabling to suppress an outflow of particles and mist generated in a grinding apparatus.

Means for Solving the Problems

In an exemplary embodiment, a grinding apparatus includes a rotary table, multiple chuck, a rotational driving unit, a grinding position cover, a cleaning unit and an attachment/detachment position cover. The horizontal rotary table is configured to be rotated around a vertical rotation center line. The multiple chucks are arranged at an equal distance therebetween around the rotation center line of the rotary table. The rotational driving unit is configured to rotate the rotary table to move the chuck between an attachment/detachment position where attachment/detachment of a substrate to/from the chuck is performed and a grinding position where grinding of the substrate placed on the chuck is performed. The grinding position cover covers the grinding position from above and from a side. The cleaning unit is configured to supply a cleaning liquid to the chuck or the substrate at the attachment/detachment position. The attachment/detachment position cover covers the attachment/detachment position from above and from a side. The attachment/detachment position cover is provided with a transfer opening for the substrate in a side surface thereof, and accommodates therein the chuck and the cleaning unit.

Effect of the Invention

According to the exemplary embodiments, it is possible to suppress the outflow of the particles and the mist generated in the grinding apparatus.

DETAILED DESCRIPTION

Figure 1:
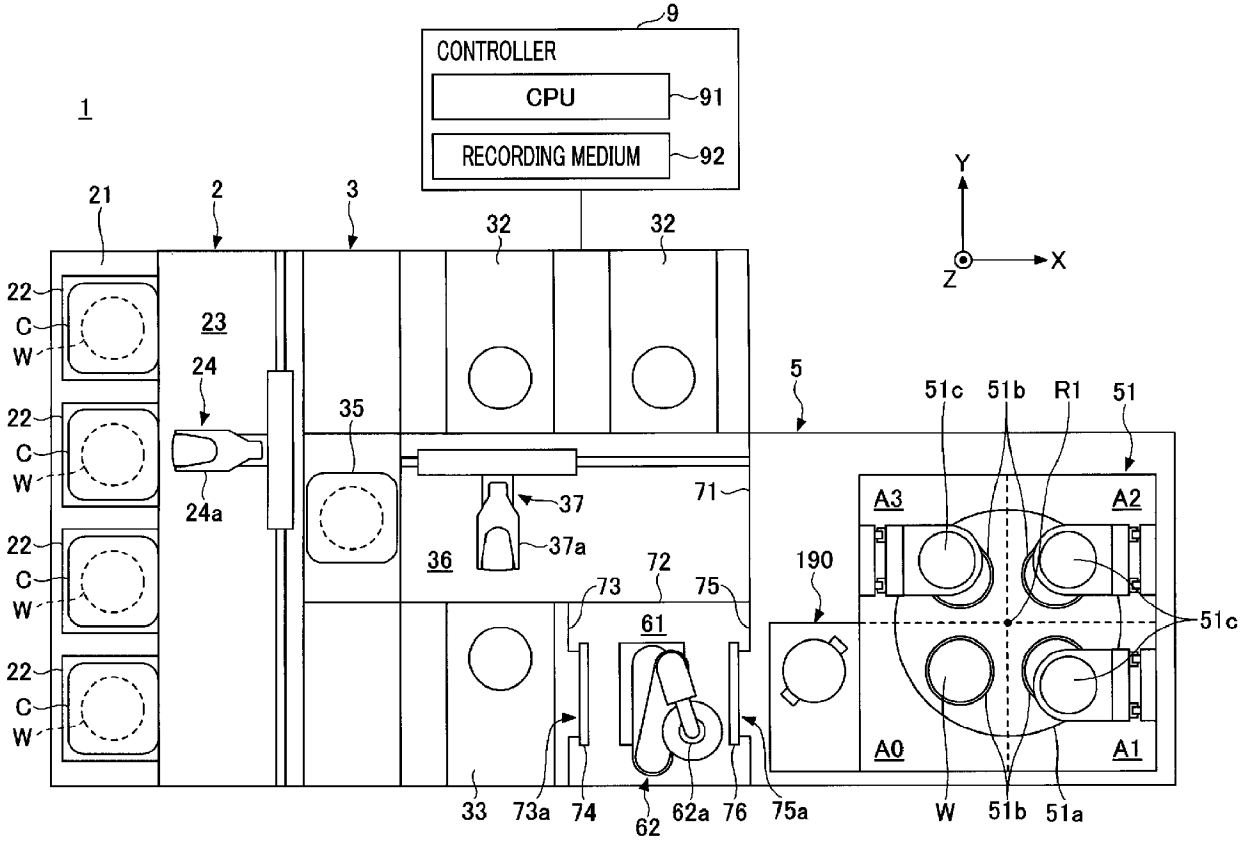
FIG. 1 is a plan view illustrating a grinding system according to an exemplary embodiment.

Hereinafter, exemplary embodiments of the present disclosure will be described with reference to the accompanying drawings. Further, in the various drawings, same or corresponding parts will be assigned same reference numerals, and redundant description will sometimes be omitted. In the present specification, the X-axis direction, the Y-axis direction and the X-axis direction are orthogonal to each other. The X-axis and Y-axis directions are horizontal directions, and the Z-axis direction is a vertical direction.

Figure 2:
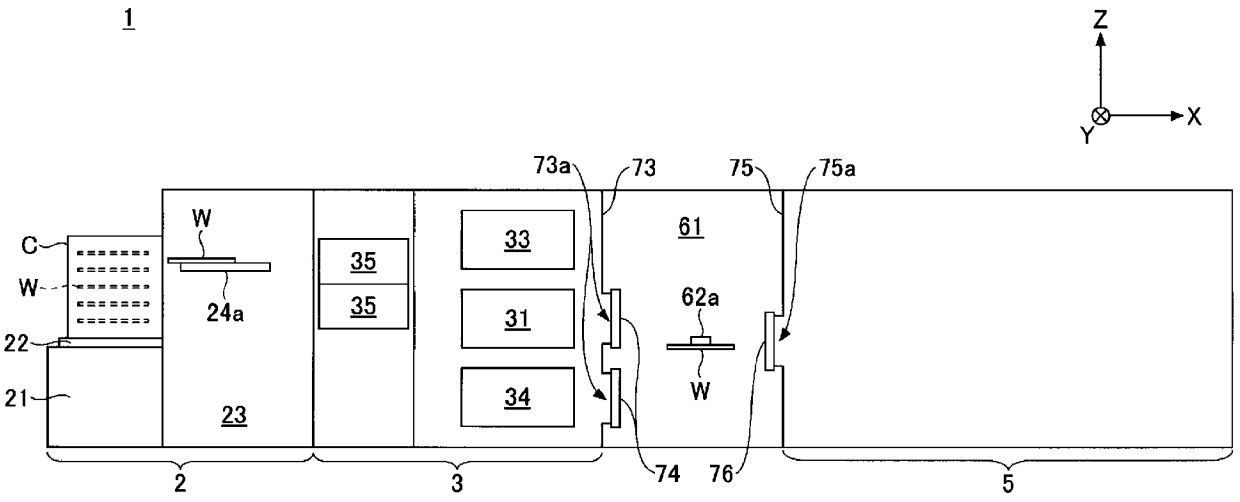
FIG. 2 is a side view illustrating the grinding system according to the exemplary embodiment.

As depicted in FIG. 1 and FIG. 2, a grinding system 1 is equipped with a carry-in/out section 2, a cleaning section 3, a grinding section 5, and a controller 9. The carry-in/out section 2, the cleaning section 3, and the grinding section 5 are disposed in this order from the negative X-axis side to the positive X-axis side.

The carry-in/out section 2 has a placing table 21. The placing table 21 is where a cassette C is placed. The cassette C accommodates therein a plurality of substrates W at a regular distance therebetween in a vertical direction. The substrate W includes a semiconductor substrate such as a silicon wafer or a compound semiconductor wafer, or a glass substrate. The substrate W may further include a device layer formed on a surface of the semiconductor substrate or the glass substrate. The device layer includes an electronic circuit. Further, the substrate W may be a combined substrate in which multiple substrates are bonded. The placing table 21 includes a plurality of placing plates 22 arranged in a row in the Y-axis direction. The cassette C is disposed on each of the plurality of placing plates 22. Here, the number of the placing plates 22 is not specifically limited. Likewise, the number of the cassettes C is not particularly limited, either.

Further, the carry-in/out section 2 has a first transfer region 23 provided next to the placing table 21. The first transfer region 23 is disposed on the positive X-axis side of the placing table 21. Further, the first transfer region 23 is disposed on the negative X-axis side of a transition device 35 to be described later.

Moreover, the carry-in/out section 2 is equipped with a first transfer device 24 disposed in the first transfer region 23. The first transfer device 24 carries the substrate W into/from the cassette C. The first transfer device 24 includes a first transfer arm 24*a* configured to hold the substrate W. The first transfer arm 24*a* is movable in horizontal directions (both the X-axis direction and the Y-axis direction) and a vertical direction, and pivotable around a vertical axis. The first transfer device 24 transfers the substrate W between the cassette C and the transition device 35. The number of the first transfer arm 24*a* may be one or more.

The cleaning section 3 is equipped with a first cleaning apparatus 31 (see FIG. 2) and a second cleaning apparatus 32. The first cleaning apparatus 31 cleans the substrate W. By way of example, the first cleaning apparatus 31 includes a non-illustrated cleaning body configured to scrub and clean the substrate W after being ground by a grinding apparatus 51 to be described later. The cleaning body is a sponge or a brush, and serves to remove particles such as grinding debris. The cleaning body needs to scrub a ground top surface of the substrate W, and is disposed above the substrate W. However, cleaning bodies may be respectively disposed above and below the substrate W to clean both the top surface and a bottom surface of the substrate W.

The second cleaning apparatus 32 also cleans the substrate W. For example, the second cleaning apparatus 32 includes a non-illustrated nozzle configured to discharge a chemical liquid for etching the substrate W after being ground by the grinding apparatus 51. The nozzle supplies the chemical liquid to a center of the top surface of the substrate W being rotated. The chemical liquid is diffused from the center of the top surface of the substrate W toward a periphery thereof by a centrifugal force. The chemical liquid may be a general one, for example, fluoronitric acid or an alkaline solution. The chemical liquid removes a grinding mark by etching the ground top surface of the substrate W.

The cleaning section 3 may be further equipped with a third cleaning apparatus 33. Unlike the first cleaning apparatus 31 and the second cleaning apparatus 32, the third cleaning apparatus 33 cleans the substrate W before being ground by the grinding apparatus 51. Accordingly, since the clean substrate W can be placed on a chuck 51*b* of the grinding apparatus 51, particles can be suppressed from being mixed in. Therefore, the substrate W can be ground flat, so it is possible to suppress deterioration of a total thickness variation (TTV) of the substrate W.

The third cleaning apparatus 33 includes, like the first cleaning apparatus 31, a cleaning body configured to clean the substrate W by scrubbing it. The cleaning body is a sponge or a brush, and serves to remove particles. The cleaning body needs to be configured to scrub the bottom surface of the substrate W in order to suppress the particles from being mixed in when the substrate W is placed on the chuck 51*b*, and is disposed under the substrate W. However, cleaning bodies may be respectively disposed above and below the substrate W to clean both the top surface and the bottom surface of the substrate W.

The cleaning section 3 has a detecting apparatus 34. The detecting apparatus 34 detects the center of the substrate W before being ground by the grinding apparatus 51. When viewed from the top, a center of the chuck 51*b* to be described later can be aligned with the center of the substrate W. The detecting apparatus 34 may be configured to detect a crystal orientation of the substrate W as well as the center of the substrate W, and, specifically, it may detect an orientation flat or a notch indicating the crystal orientation of the substrate W. On a rotational coordinate system that is rotated along with the chuck 51*b*, the crystal orientation of the substrate W can be aligned to a required direction.

The first cleaning apparatus 31, the third cleaning apparatus 33, and the detecting apparatus 34 may be vertically stacked to reduce the installation area of the grinding system 1. Further, in the present exemplary embodiment, as depicted in FIG. 2, the detecting apparatus 34, the first cleaning apparatus 31, and the third cleaning apparatus 33 are arranged in this order from the lower side toward the upper side. However, the order is not particularly limited. For example, the detecting apparatus 34 or the first cleaning apparatus 31 may be disposed at the top. Furthermore, the third cleaning apparatus 33 or the first cleaning apparatus 31 may be disposed at the bottom.

The cleaning section 3 has the transition device 35. The transition device 35 accommodates therein the substrate W temporarily. The transition device 35 may be plural in number, and the plurality of transition devices 35 may be stacked in a vertical direction. The layout and the number of the transition device 35 are not particularly limited.

As illustrated in FIG. 1, the cleaning section 3 has a second transfer region 36 disposed between the first cleaning apparatus 31 and the second cleaning apparatus 32. The second cleaning apparatus 32 is disposed on the positive Y-axis side of the second transfer region 36, and the first cleaning apparatus 31, the third cleaning apparatus 33, and the detecting apparatus 34 are disposed on the negative Y-axis side of the second transfer region 36. Further, the transition device 35 is disposed on the negative X-axis side of the second transfer region 36, and the grinding apparatus 51 is disposed on the positive X-axis side of the second transfer region 36.

The cleaning section 3 is equipped with a second transfer device 37 disposed in the second transfer region 36. The second transfer device 37 transfers the substrate W to/from the first cleaning apparatus 31, the second cleaning apparatus 32, the third cleaning apparatus 33, the detecting apparatus 34, and the transition device 35.

The second transfer device 37 includes a second transfer arm 37*a* configured to hold the substrate W. The second transfer arm 37*a* is movable in horizontal directions (both the X-axis direction and the Y-axis direction) and a vertical direction, and pivotable around a vertical axis. The second transfer arm 37*a* holds the substrate W from below. The substrate W is placed on the second transfer arm 37*a*. The number of the second transfer arm 37*a* may be one or more.

The grinding section 5 includes the grinding apparatus 51. The grinding apparatus 51 is configured to grind the substrate W. The grinding includes polishing. Abrasive grains for use in the grinding may be fixed abrasive grains or free abrasive grains. The grinding apparatus 51 includes, for example, a rotary table 51*a*, four chucks 51*b*, and three grinding units 51*c*.

Figure 6:
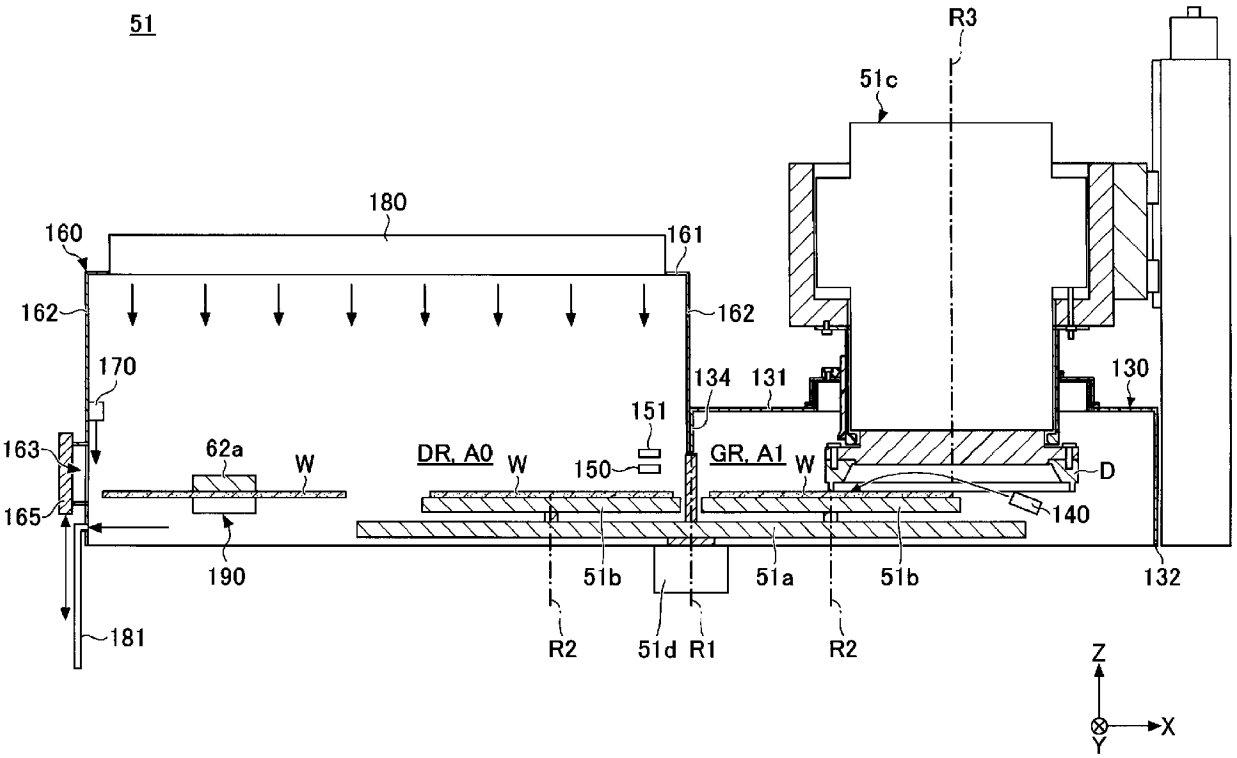
FIG. 6 is a cross sectional view illustrating examples of the grinding position cover and the attachment/detachment position cover.

The rotary table 51*a* is configured to hold the four chucks 51*b* around a rotation center line R1 at an equal distance therebetween, and is rotated about the rotation center line R1. A rotational driving unit 51*d* shown in FIG. 6 is used for the rotation of the rotary table 51*a*. The rotational driving unit 51*d* includes, by way of example, a rotation motor. Each of the four chucks 51*b* is rotated together with the rotary table 51*a* and is moved to an attachment/detachment position A0, a first grinding position A1, a second grinding position A2, a third grinding position A3, and the attachment/detachment position A0 in this sequence.

The attachment/detachment position A0 is a position where attachment/detachment of the substrate W to/from the chuck 51*b* is performed, and serves as both a position where the substrate W is attached and a position where the substrate W is detached. The first grinding position A1 is a position where first grinding of the substrate W is performed. The second grinding position A2 is a position where second grinding of the substrate W is performed. The third grinding position A3 is a position where third grinding of the substrate W is performed.

Figure 4:
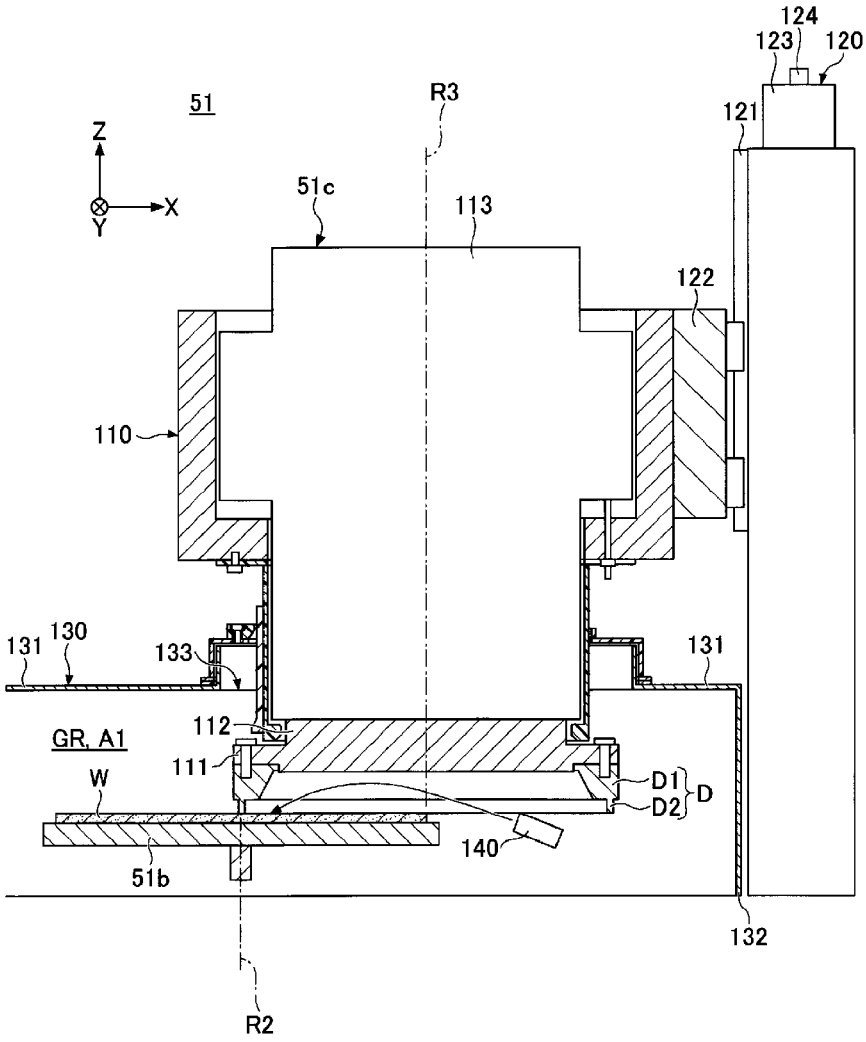
FIG. 4 is a cross sectional view illustrating an example of a grinding position cover and a grinding unit.

The four chucks 51*b* are mounted to the rotary table 51*a* so as to be rotatable about their own rotation center lines R2 (see FIG. 4). At the first grinding position A1, the second grinding position A2, and the third grinding position A3, the chucks 51*b* are rotated about their own rotation center lines R2.

One of the grinding units 51*c* performs the first grinding of the substrate W at the first grinding position A1. Another grinding unit 51*c* performs the second grinding of the substrate W at the second grinding position A2. The other grinding unit 51*c* performs the third grinding of the substrate W at the third grinding position A3.

Here, the number of the grinding units 51*c* may be one or more. In addition, the number of the chucks 51*b* needs to be larger than the number of the grinding units 51*c*.

As shown in FIG. 1, the grinding system 1 includes a third transfer region 61 disposed between the cleaning section 3 and the grinding section 5. The third transfer region 61 is disposed adjacent to the first cleaning apparatus 31 and the second transfer region 36 and opposite to the second cleaning apparatus 32 with the second transfer region 36 therebetween.

The cleaning section 3 has a shape in which a corner of a rectangle is notched when viewed from the top, and the third transfer region 61 is disposed at the notched position. The third transfer region 61 may be provided inside a housing that covers both the cleaning section 3 and the third transfer region 61, or may be provided inside a housing different from a housing covering the cleaning section 3 and may be connected to the cleaning section 3.

The grinding system 1 is equipped with a third transfer device 62 provided in the third transfer region 61. The third transfer device 62 transfers the substrate W to/from the cleaning section 3 and the grinding section 5. To elaborate, the third transfer device 62 transfers the substrate W from the detecting apparatus 34 to the chuck 51*b* of the grinding apparatus 51, and transfers the substrate W from the chuck 51*b* to the first cleaning apparatus 31. Furthermore, the third transfer device 62 may transfer the substrate W from the third cleaning apparatus 33 to the chuck 51*b* of the grinding apparatus 51. In this case, a transfer opening 73*a* to be described later is provided in the vicinity of the third cleaning apparatus 33.

The third transfer device 62 includes an attraction pad 62*a* configured to hold the substrate W. The attraction pad 62*a* attracts the substrate W from above. The attraction pad 62*a* is movable in horizontal directions (both the X-axis direction and the Y-axis direction) and in a vertical direction, and pivotable around a vertical axis.

The cleaning section 3 and the grinding section 5 are separated by a partition wall 71. For example, the partition wall 71 separates the second transfer region 36 of the cleaning section 3 from the grinding section 5, for example. Due to the presence of the partition wall 71, an outflow of particles and mist from the grinding section 5 to the cleaning section 3 can be suppressed.

According to the present exemplary embodiment, since the cleaning section 3 can be separated from the grinding section 5, the cleaning apparatuses can be provided in an area having a high degree of cleanliness. Further, since the most area of the grinding section 5 is occupied by the grinding apparatus 51, the number of the provided cleaning apparatuses can be increased, as compared to a case where the cleaning apparatuses are provided in the remaining area of the grinding section 5. Therefore, cleaning performance can be improved. Moreover, since the cleaning apparatuses are provided in the area with the high degree of cleanliness, the substrate W after being cleaned can be maintained clean.

Moreover, according to the present exemplary embodiment, the third transfer region 61 is disposed at the notched position of the cleaning section 3. Therefore, it is possible to suppress an increase of the occupation area of the grinding system 1 that might be caused by the increase of the number of the provided cleaning apparatuses.

The cleaning section 3 and the third transfer region 61 are separated by partition walls 72 and 73. The partition wall 72 separates the second transfer region 36 of the cleaning section 3 from the third transfer region 61. Further, the partition wall 73 separates the first cleaning apparatus 31 of the cleaning section 3 from the third transfer region 61. Due to the presence of the partition walls 72 and 73, the particles and the mist can be suppressed from being flown out to the cleaning section 3 from the grinding section 5 through the third transfer region 61.

The partition wall 73 is provided with the transfer opening 73*a* through which the substrate W passes. The substrate W is transferred from the detecting apparatus 34 to the chuck 51*b* of the grinding apparatus 51 through the transfer opening 73*a* of the partition wall 73. Further, the substrate W is transferred from the chuck 51*b* to the first cleaning apparatus 31 through the transfer opening 73*a* of the partition wall 73.

A shutter 74 configured to open or close the transfer opening 73*a* is provided at the transfer opening 73*a* of the partition wall 73. The shutter 74 basically closes the transfer opening 73*a* of the partition wall 73, and opens the transfer opening 73*a* of the partition wall 73 when the substrate W passes. As compared to a case where the transfer opening 73*a* is always opened, it is possible to suppress the particles and the mist from being flown out to the cleaning section 3 from the grinding section 5 through the transfer opening 73*a*. Therefore, the cleanliness of the cleaning section 3 can be further improved.

The grinding section 5 and the third transfer region 61 are separated by a partition wall 75. The partition wall 75 is an outer wall of the grinding section 5. Due to the presence of the partition wall 75, the particles and the mist can be suppressed from being flown out to the cleaning section 3 from the grinding section 5 via the third transfer region 61.

The partition wall 75 is provided with a transfer opening 75*a* through which the substrate W passes. The partition wall 75 extends to both above and below the transfer opening 75*a*. The substrate W before being ground is transferred from the detecting apparatus 34 to the chuck 51*b* of the grinding apparatus 51 through the transfer opening 75*a* of the partition wall 75. Further, the substrate W after being ground is transferred from the chuck 51*b* of the grinding apparatus 51 to the first cleaning apparatus 31 through the transfer opening 75*a* of the partition wall 75.

A shutter 76 configured to open or close the transfer opening 75*a* is provided at the transfer opening 75*a* of the partition wall 75. The shutter 76 basically closes the transfer opening 75*a* of the partition wall 75, and opens the transfer opening 75*a* of the partition wall 75 when the substrate W passes. As compared to a case where the transfer opening 75*a* is always opened, it is possible to suppress the particles and the mist from being flown out to the cleaning section 3 from the grinding section 5 through the transfer opening 75*a*. Therefore, the cleanliness of the cleaning section 3 can be further improved.

The controller 9 is, for example, a computer, and includes a CPU (Central Processing Unit) 91 and a recording medium 92 such as a memory. The recording medium 92 stores therein a program for controlling various processings performed in the grinding system 1. The controller 9 controls an operation of the grinding system 1 by causing the CPU 91 to execute the program stored in the recording medium 92.

Next, the operation of the grinding system 1 will be explained. The following operations are performed under the control of the controller 9.

First, the first transfer device 24 takes out the substrate W from the cassette C, and transfers it to the transition device 35. Then, the second transfer device 37 transfers the substrate W from the transition device 35 to the third cleaning apparatus 33.

Next, the third cleaning apparatus 33 cleans the substrate W before being subjected to grinding by the grinding apparatus 51. Since the cleaned substrate W can be placed on the chuck 51*b* of the grinding apparatus 51, particles can be suppressed from being mixed therein. Therefore, the substrate W can be ground flat, so that deterioration of a thickness variation of the substrate W can be suppressed. The third cleaning apparatus 33 cleans the bottom surface of the substrate W. After the substrate W is dried, the second transfer device 37 transfers the substrate W from the third cleaning apparatus 33 to the detecting apparatus 34.

Here, if the substrate W before being subjected to the grinding is clean, or if the grinding apparatus 51 has a mechanism configured to clean the substrate W before being ground, the third cleaning apparatus 33 may be omitted. In such a case, the second transfer device 37 transfers the substrate W from the transition device 35 to the detecting apparatus 34.

Subsequently, the detecting apparatus 34 detects the center of the substrate W. The detecting apparatus 34 may also detect a notch of the substrate W or the like. Thereafter, the third transfer device 62 transfers the substrate W from the detecting apparatus 34 to the chuck 51*b* of the grinding apparatus 51.

The controller 9 controls the third transfer device 62 based on the detection result of the detecting apparatus 34 to align the rotation center line R2 of the chuck 51*b* with the center of the substrate W. Further, the controller 9 controls the third transfer device 62 based on the detection result of the detecting apparatus 34 to align the crystal orientation of the substrate W to a required direction on a rotation coordinate system which is rotated along with the chuck 51*b*.

Next, the grinding apparatus 51 grinds the top surface of the substrate W. The substrate W is rotated along with the rotary table 51*a* to be moved to the attachment/detachment position A0, the first grinding position A1, the second grinding position A2, the third grinding position A3, and the attachment/detachment position A0 in this order. In the meantime, the first grinding, the second grinding, and the third grinding are performed in this order. Thereafter, the third transfer device 62 transfers the substrate W from the chuck 51*b* to the first cleaning apparatus 31.

Then, the first cleaning apparatus 31 cleans the top surface of the substrate W to remove the particles. After the substrate W is dried, the second transfer device 37 transfers the substrate W from the first cleaning apparatus 31 to the second cleaning apparatus 32.

Subsequently, the second cleaning apparatus 32 etches the top surface of the substrate W to remove a grinding mark. After the substrate W is dried, the second transfer device 37 transfers the substrate W from the second cleaning apparatus 32 to the transition device 35. Then, the first transfer device 24 transfers the substrate W from the transition device 35 to the cassette C. The substrate W is accommodated in the cassette C.

In addition, although the first transfer device 24 of the present exemplary embodiment transfers the substrate W taken out from the cassette C to the transition device 35, the technique of the present disclosure is not limited thereto. The first transfer device 24 may transfer the substrate W taken out from the cassette C to the third cleaning apparatus 33 or the detecting apparatus 34.

Next, with reference to FIG. 4, etc., the grinding unit 51*c* of the grinding apparatus 51 will be explained. The grinding unit 51*c* includes a movable unit 110 to which a grinding tool D is mounted. The grinding tool D comes into contact with the substrate W and grinds it. The grinding tool D includes, for example, a disk-shaped grinding wheel D1 and a plurality of whetstones D2 arranged in a ring shape on a bottom surface of the grinding wheel D1.

The movable unit 110 includes a flange 111 to which the grinding tool D is mounted, a spindle shaft 112 having the flange 111 at a lower end thereof, and a spindle motor 113 configured to rotate the spindle shaft 112. The flange 111 is disposed horizontally, and the grinding tool D is mounted on a bottom surface thereof. The spindle shaft 112 is vertically disposed. The spindle motor 113 is configured to rotate the spindle shaft 112, thus allowing the grinding tool D mounted to the flange 111 to be rotated. A rotation center line R3 of the grinding tool D coincides with a rotation center line of the spindle shaft 112.

The grinding unit 51*c* further includes an elevating unit 120 configured to move the movable unit 110 up and down. The elevating unit 120 includes, for example, a vertical Z-axis guide 121, a Z-axis slider 122 configured to be moved along the Z-axis guide 121, and a Z-axis motor 123 configured to move the Z-axis slider 122. The movable unit 110 is fixed to the Z-axis slider 122, and the movable unit 110 and the grinding tool D are moved up and down along with the Z-axis slider 122. The elevating unit 120 is further equipped with a position detector 124 configured to detect the position of the grinding tool D. For example, the position detector 124 detects the rotation of the Z-axis motor 123 to detect the position of the grinding tool D.

The elevating unit 120 lowers the grinding tool D from a standby position. The grinding tool D is rotated while being lowered, comes into contact with the top surface of the substrate W being rotated, and grinds the entire top surface of the substrate W. When the thickness of the substrate W reaches a set value, the elevating unit 120 stops the lowering of the grinding tool D. Thereafter, the elevating unit 120 raises the grinding tool D up to the standby position.

As shown in FIG. 4, the grinding apparatus 51 has a grinding position cover 130 and a grinding liquid nozzle 140. For example, the grinding position cover 130 covers the first grinding position A1, the second grinding position A2, and the third grinding position A3 from above and from the side. The grinding position cover 130 accommodates therein the chuck 51*b*, the grinding tool D, and the grinding liquid nozzle 140. The grinding liquid nozzle 140 is configured to supply the grinding liquid into a gap between the grinding tool D and the substrate W held by the chuck 51*b*.

The grinding position cover 130 suppresses the grinding liquid and the particles such as grinding debris from being scattered to the outside thereof. The grinding position cover 130 has a top panel 131 disposed horizontally; and a side panel 132 disposed vertically. An insertion opening 133 of the movable unit 110 is formed in the top panel 131. The grinding position cover 130 has therein a grinding chamber GR in which the grinding of the substrate W is performed. A non-illustrated collecting pan (not shown) is provided under the grinding position cover 130. The collecting pan recovers the particles and the grinding liquid.

The grinding liquid nozzle 140 supplies the grinding liquid. The grinding liquid is, for example, pure water such as DIW (Deionized Water). The grinding liquid enters the gap between the substrate W and the grinding tool D, and reduces grinding resistance to suppress heat generation.

Figure 5:
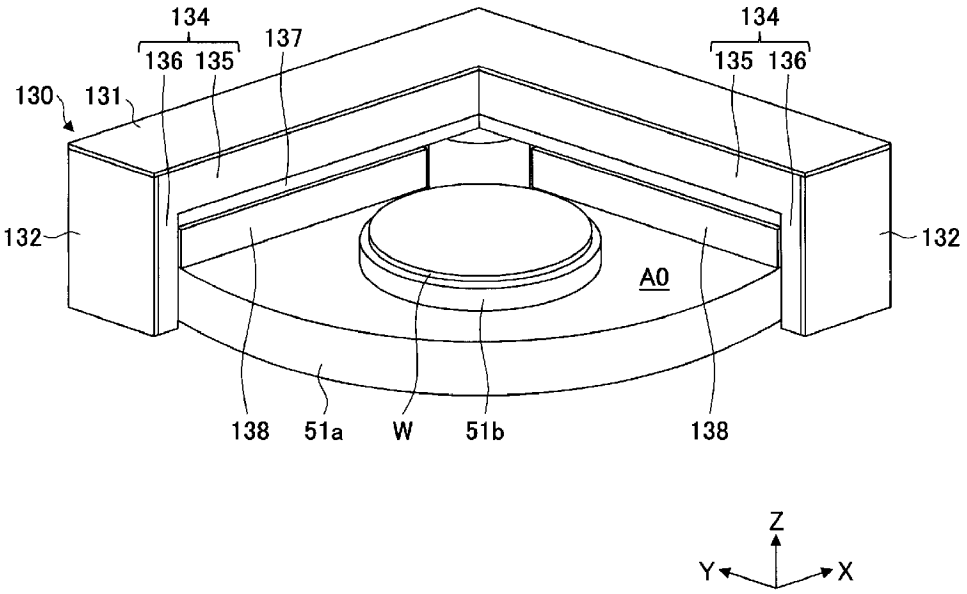
FIG. 5 is a perspective view illustrating an example of the grinding position cover.

As illustrated in FIG. 5, the grinding position cover 130 has a fixed partition wall 134. The fixed partition wall 134 is provided on a bottom surface of the top panel 131. The fixed partition wall 134 is plural in number, and these fixed partition walls 134 are arranged at an equal distance therebetween around the rotation center line R1 of the rotary table 51*a* to separate the grinding chamber GR for the first grinding, a grinding chamber for the second grinding, a grinding chamber for the third grinding, and an attachment/detachment chamber DR to be described later.

The fixed partition wall 134 includes, for example, a top member 135 and a side member 136. The top member 135 is mounted on the bottom surface of the top panel 131 and forms a gap with respect to the rotary table 51*a*. This gap allows the chuck 51*b* and the substrate W to pass therethrough when the rotary table 51*a* is rotated. Provided on a lower edge of the top member 135 is a flexible sheet 137 of a rectangular shape that closes a gap between the top member 135 and the substrate W. The side member 136 is mounted on an inner wall surface of the side panel 132. The side member 136 is protruded downwards from the top member 135 and closes a gap between a side surface of the rotary table 51*a* and the side panel 132.

Meanwhile, rotary partition walls 138 are provided on a top surface of the rotary table 51*a*, and are rotated along with the rotary table 51*a*. The number of the rotary partition walls 138 is the same as the number of the fixed partition walls 134. When the rotation of the rotary table 51*a* is stopped, the rotary partition walls 138 are located directly under the fixed partition walls 134. Due to the presence of the fixed partition wall 134 and the rotary partition wall 138, it is possible to suppress the particles generated in the grinding chamber GR from being flown out to the outside of the grinding chamber GR.

Figure 3:
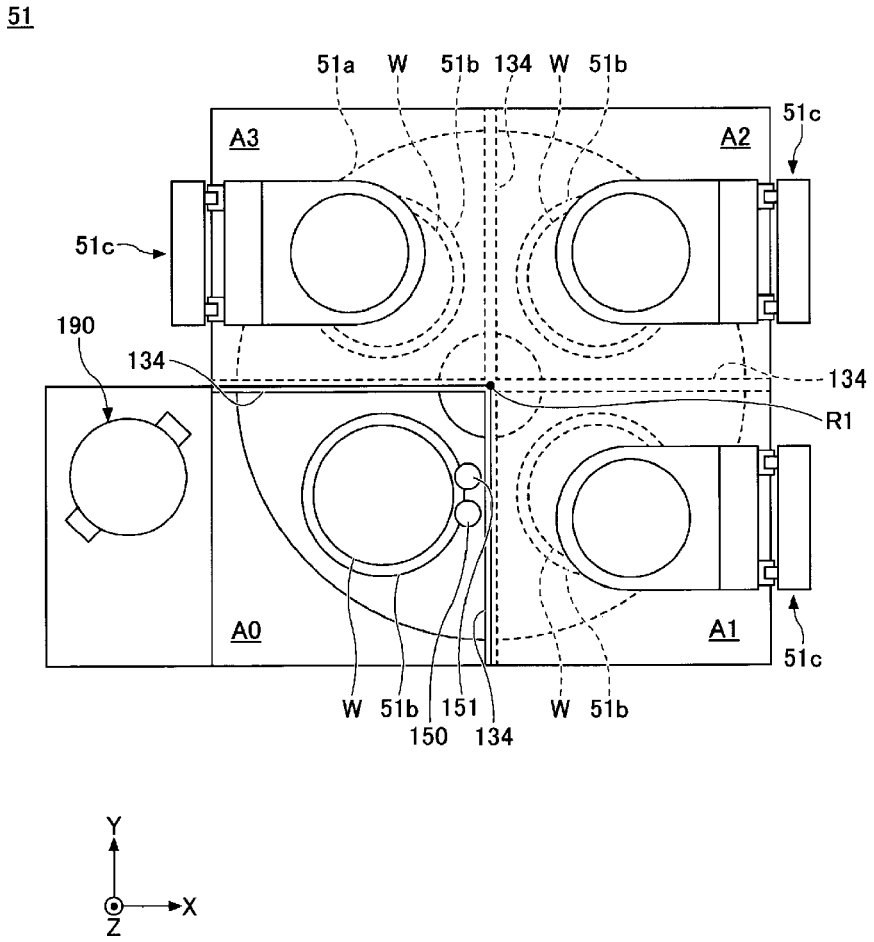
FIG. 3 is a plan view illustrating a state in which an attachment/detachment position cover of a grinding apparatus is removed.

As shown in FIG. 3, the grinding position cover 130 has a shape in which a corner of a rectangle is notched when viewed from the top, and the attachment/detachment position A0 is disposed at this notched position. At the attachment/detachment position A0, a supply of a cleaning liquid to the substrate W after being ground is performed before the substrate W is carried-out. Further, at the attachment/detachment position A0, a supply of the cleaning liquid to the chuck 51*b* is performed after the substrate W is carried-out and before a next substrate W is carried-in.

The grinding apparatus 51 includes a substrate cleaning unit 150 configured to supply the cleaning liquid to the substrate W at the attachment/detachment position A0. The substrate cleaning unit 150 supplies the cleaning liquid to the top surface of the substrate W being rotated along with the chuck 51*b*. The cleaning liquid is diffused onto the entire top surface of the substrate W by a centrifugal force to thereby wash off the particles adhering to the top surface of the substrate W. The cleaning liquid may be, by way of non-limiting example, DIW.

The substrate cleaning unit 150 is equipped with, for example, a nozzle configured to discharge the cleaning liquid. The nozzle may be configured to be moved above the substrate W. At this time, the substrate W is being rotated along with the chuck 51*b*, and the nozzle is moved in a diametrical direction of the substrate W while discharging the cleaning liquid. The nozzle may reverse its moving direction when it reaches positions directly above the center and the edge of the substrate W. Alternatively, the nozzle may not immediately reverse its moving direction at the position directly above the center of the substrate W, but it may just pass through the position directly above the center of the substrate W and reverse the moving direction when it reaches the position directly above the edge of the substrate W.

The grinding apparatus 51 is equipped with a chuck cleaning unit 151 configured to supply the cleaning liquid to the chuck 51*b* at the attachment/detachment position A0. The chuck cleaning unit 151 supplies the cleaning liquid to the top surface of the rotating chuck 51*b*. The cleaning liquid is diffused onto the entire top surface of the chuck 51*b* by a centrifugal force to thereby wash off the particles adhering to the top surface of the chuck 51*b*. The cleaning liquid may be, for example, DIW.

The chuck cleaning unit 151 is equipped with, for example, a nozzle configured to discharge the cleaning liquid. The nozzle may be configured to be moved above the chuck 51*b*. At this time, the chuck 51*b* is being rotated, and the nozzle is moved in a diametrical direction of the chuck 51*b* while discharging the cleaning liquid. The nozzle may reverse its moving direction when it reaches positions directly above the center and the edge of the chuck 51*b*. Alternatively, the nozzle may not immediately reverse its moving direction at the position directly above the center of the chuck 51*b*, but it may just pass through the position directly above the center of the chuck 51*b* and reverse the moving direction when it reaches the position directly above the edge of the chuck 51*b*.

The chuck cleaning unit 151 may include a friction body configured to rub and clean the top surface of the chuck 51*b*. The friction body is, for example, a brush, a sponge or a whetstone. Two or more selected from the brush, the sponge and the whetstone may be used. The friction body is moved above the chuck 51*b*. At this time, the chuck 51*b* is being rotated, and the friction body is moved in the diametrical direction of the chuck 51*b*. When the friction body reaches the center and the edge of the chuck 51*b*, it may reverse its moving direction. Alternatively, the friction body may not reverse its moving direction at the center of the chuck 51*b*, but it may just pass through the center of the chuck 51*b* and reverse the moving direction when it reaches the edge of the chuck 51*b*.

When the chuck 51*b* includes a porous body as a vacuum-attracting chuck, an ejector configured to supply a fluid to the inside of the porous body and eject the fluid from a top surface of the porous body may be provided. The top surface of the porous body has a number of recesses. Particles that have entered the recesses can also be removed by blowing them with an ejection pressure of the fluid. As an example of the fluid, the ejector ejects a mixed fluid of a liquid such as water and a gas such as air or a nitrogen gas from the top surface of the porous body. Here, although only the liquid or only the gas may be used as the fluid, the efficiency of the particle removal can be improved by using the mixed fluid of the liquid and the gas.

As stated above, at the attachment/detachment position A0, the cleaning liquid is supplied to the top surface of the chuck 51*b*, so that the particles adhering to the top surface of the chuck 51*b* are washed away by the cleaning liquid. Since the substrate W can be disposed on the clean top surface of the chuck 51*b*, the particles can be suppressed from being mixed therein. Therefore, the substrate W can be ground flat, and deterioration of the thickness variation of the substrate W can be suppressed.

However, at the attachment/detachment position A0, the particles may fly off. Furthermore, the mist of the cleaning liquid may be generated.

As a resolution, the grinding apparatus 51 of the present exemplary embodiment has an attachment/detachment position cover 160, as shown in FIG. 6. The attachment/detachment position cover 160 covers the attachment/detachment position A0 from above and from the side. The attachment/detachment position cover 160 accommodates therein the chuck 51*b*, the substrate cleaning unit 150 and the chuck cleaning unit 151.

The attachment/detachment position cover 160 keeps the generated particles and mist inside, and suppresses an outflow of the particles and the mist. Therefore, the particles and the mist can be suppressed from being flown out from the grinding section 5 to the cleaning section 3, so that the cleaning section 3 can be kept clean.

In addition, the attachment/detachment position cover 160 also serves to suppress introduction of the particles from the outside to the inside thereof. Therefore, it is possible to place the clean substrate W on the top surface of the clean chuck 51*b*, so that the particles can be suppressed from being mixed therein. Therefore, the substrate W can be ground flat, and the deterioration of the thickness variation of the substrate W can be suppressed.

The attachment/detachment position cover 160 forms therein the attachment/detachment chamber DR in which the attachment/detachment of the substrate W to/from the chuck 51*b* is performed. A non-illustrated collecting pan is provided under the attachment/detachment position cover 160. The collecting pan collects the particles and the cleaning liquid.

The attachment/detachment position cover 160 is separated from the grinding position cover 130 and is thus removable. If the attachment/detachment position cover 160 is removed, the attachment/detachment chamber DR can be opened, so that workability of maintenance can be improved.

The attachment/detachment position cover 160 has a horizontally disposed top panel 161 and a vertically disposed side panel 162. The top panel 161 is formed to have a rectangular shape when viewed from the top. The side panel 162 is provided at each of the four sides of the top panel 161.

A transfer opening 163 for the substrate W is formed in the side panel 162. The transfer opening 163 is formed in the side panel 162 near the third transfer region 61. The substrate W is carried into the grinding apparatus 51 from the outside thereof through the transfer opening 163, and is carried out from the grinding apparatus 51 to the outside thereof through the transfer opening 163.

The substrate W is horizontally held by the third transfer device 62 when it passes through the transfer opening 163. The shape of the horizontally held substrate W is a rectangle when viewed from the side. The length of the long side of the rectangle is equal to the diameter of the substrate W, and the length of the short side of the rectangle is equal to the thickness of the substrate W. Meanwhile, the shape of the horizontally held substrate W is a circle when viewed from above. The diameter of the circle is equal to the diameter of the substrate W. Accordingly, the size of the horizontally held substrate W seen from the side is smaller than the size thereof seen from above. For this reason, if the transfer opening 163 is formed in the side panel 162, the size of the transfer opening 163 can be made smaller than that in the case of forming it in the top panel 161.

A shutter 165 configured to open or close the transfer opening 163 may be provided at the transfer opening 163. The shutter 165 basically closes the transfer opening 163, and opens the transfer opening 163 when the substrate W passes. As compared to a case where the transfer opening 163 is always opened, it is possible to suppress the outflow of the particles and the mist from the grinding section 5 to the cleaning section 3 through the transfer opening 163, so that the cleanliness of the cleaning section 3 can be further improved.

The grinding apparatus 51 may be equipped with, within the attachment/detachment position cover 160, a gas supply nozzle 170 configured to discharge a gas to the substrate W from above before the substrate W is carried out from the transfer opening 163. The gas supply nozzle 170 is provided near the transfer opening 163 to blow off the cleaning liquid remaining on the substrate W. Thus, it is possible to suppress the cleaning liquid from coming out together with the substrate W. The gas may be air, a nitrogen gas, or the like.

A height of a ceiling of the attachment/detachment position cover 160 may be higher than a height of a ceiling of the grinding position cover 130. That is, the height of the top panel 161 of the attachment/detachment position cover 160 may be higher than the height of the top panel 131 of the grinding position cover 130. Since the height of the ceiling of the attachment/detachment position cover 160 is high, it is possible to suppress the mist of the cleaning liquid and the particles from flying up to the ceiling thereof.

Assuming that the mist of the cleaning liquid is attached to the ceiling and dried thereat, residues contained in the mist become particles.

According to the present exemplary embodiment, since the height of the ceiling of the attachment/detachment position cover 160 is high, it is possible to suppress the mist of the cleaning liquid and the particles from flying up to the ceiling. As a result, the number of particles adhering to the ceiling can be reduced, and a drop of the particles from the ceiling can be suppressed. Thus, the adhesion of the particles to the chuck 51*b* or the substrate W can be suppressed.

The grinding apparatus 51 may have, at the ceiling of the attachment/detachment position cover 160, a gas supply unit 180 configured to form a downflow within the attachment/detachment position cover 160. The gas supply unit 180 is, for example, a fan filter unit or the like, and is configured to supply a gas such as air or a nitrogen gas to directly below in order to form the downflow. This downflow suppresses the mist of the cleaning liquid and the particles from flying up to the ceiling of the attachment/detachment position cover 160.

The grinding apparatus 51 is equipped with an exhaust unit 181 configured to exhaust the gas inside the attachment/detachment position cover 160 in a direction opposite to the grinding position cover 130. The exhaust unit 181 is, for example, a duct, and is connected to the side panel 162 of the attachment/detachment position cover 160. The connection position is set to be as low as possible so that the downflow can be formed within the attachment/detachment position cover 160 and a downward gas curtain can be formed in front of the transfer opening 163 by the gas supply nozzle 170. That is, the connection position is set to be located below the transfer opening 163 at least. This connection position is located above the collecting pan which collects the grinding liquid. The exhaust unit 181 may form an airflow flowing from the attachment/detachment chamber DR to the opposite side of the grinding chamber GR, thus suppressing the mist of the cleaning liquid and the particles from reaching the grinding chamber GR.

The grinding apparatus 51 is equipped with a bottom surface cleaning mechanism 190 next to the attachment/detachment position A0. The bottom surface cleaning mechanism 190 is configured to clean the bottom surface of the substrate W after being ground and detached from the chuck 51*b*. The bottom surface cleaning mechanism 190 may also clean the attraction pad 62*a* of the third transfer device 62. The bottom surface cleaning mechanism 190 has, by way of example, a nozzle configured to discharge a cleaning liquid to the substrate W or the attraction pad 62*a*; and a drying unit configured to remove the cleaning liquid from the substrate W or the attraction pad 62*a*. For example, the drying unit is configured to absorb the cleaning liquid.

The attachment/detachment position cover 160 may cover the bottom surface cleaning mechanism 190 from above and from the side as well. Accordingly, since the mist of the cleaning liquid and the particles generated in the bottom surface cleaning mechanism 190 can be made to stay inside, the particles and the mist can be suppressed from being flown out.

Figure 7:
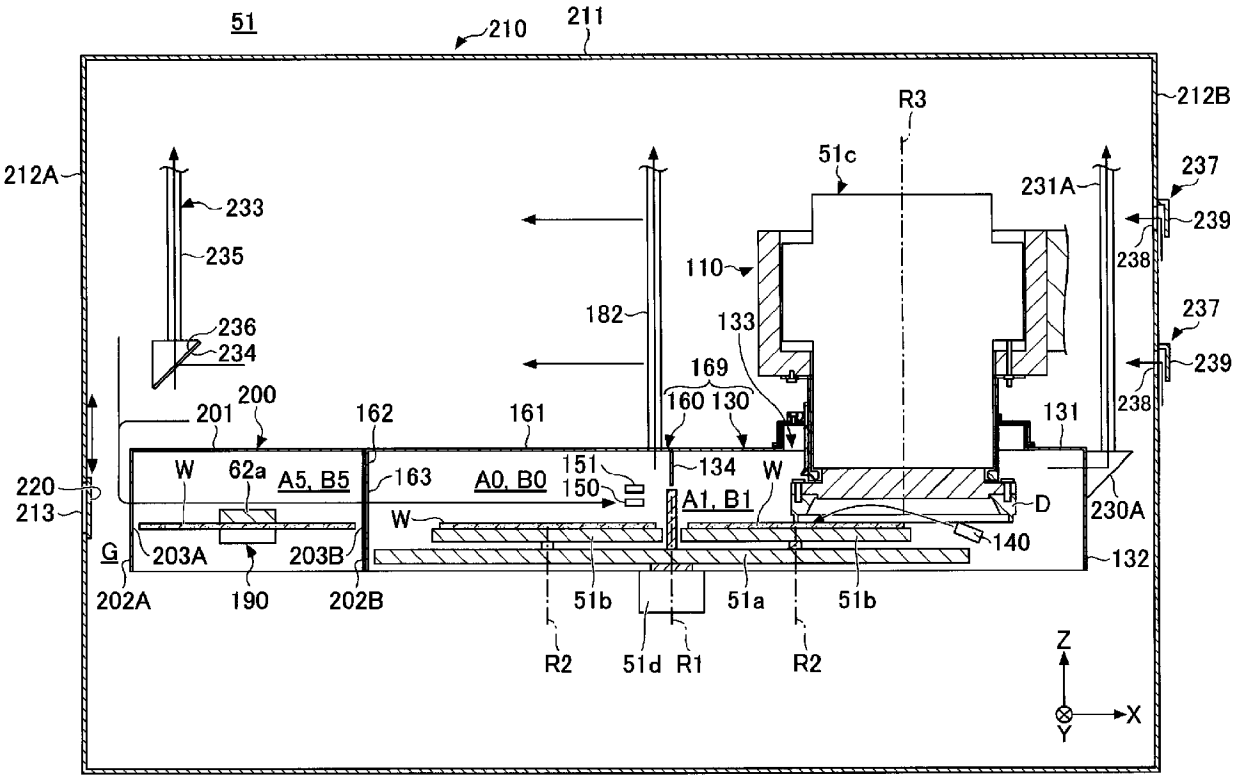
FIG. 7 is a cross sectional view perpendicular to the Y-axis direction of a grinding apparatus according to a modification example.

Now, with reference to FIG. 7 to FIG. 9, the grinding apparatus 51 according to a modification example will be described. As shown in FIG. 7, the grinding apparatus 51 has the rotary table 51*a*, the chuck 51*b*, and the grinding unit 51*c*. The grinding unit 51*c* includes the movable unit 110 to which the grinding tool D is mounted.

The grinding apparatus 51 has the grinding position cover 130 and the attachment/detachment position cover 160. For example, the grinding position cover 130 covers the first grinding position A1, the second grinding position A2, and the third grinding position A3 from above and from the side. Meanwhile, the attachment/detachment position cover 160 covers the attachment/detachment position A0 from above and from the side. A non-illustrated collecting pan is provided below the grinding position cover 130 and the attachment/detachment position cover 160. The collecting pan collects grinding debris, a grinding liquid, and so forth.

The grinding position cover 130, the attachment/detachment position cover 160 and the collecting pan are connected to form an inner housing 169. The inner housing 169 suppresses the grinding debris and the grinding liquid from being scattered to the outside. The inner housing 169 accommodates therein the chuck 51*b*, the grinding tool D, the substrate cleaning unit 150, and the chuck cleaning unit 151. The inner housing 169 may also accommodate the rotary table 51*a* therein.

Figure 9:
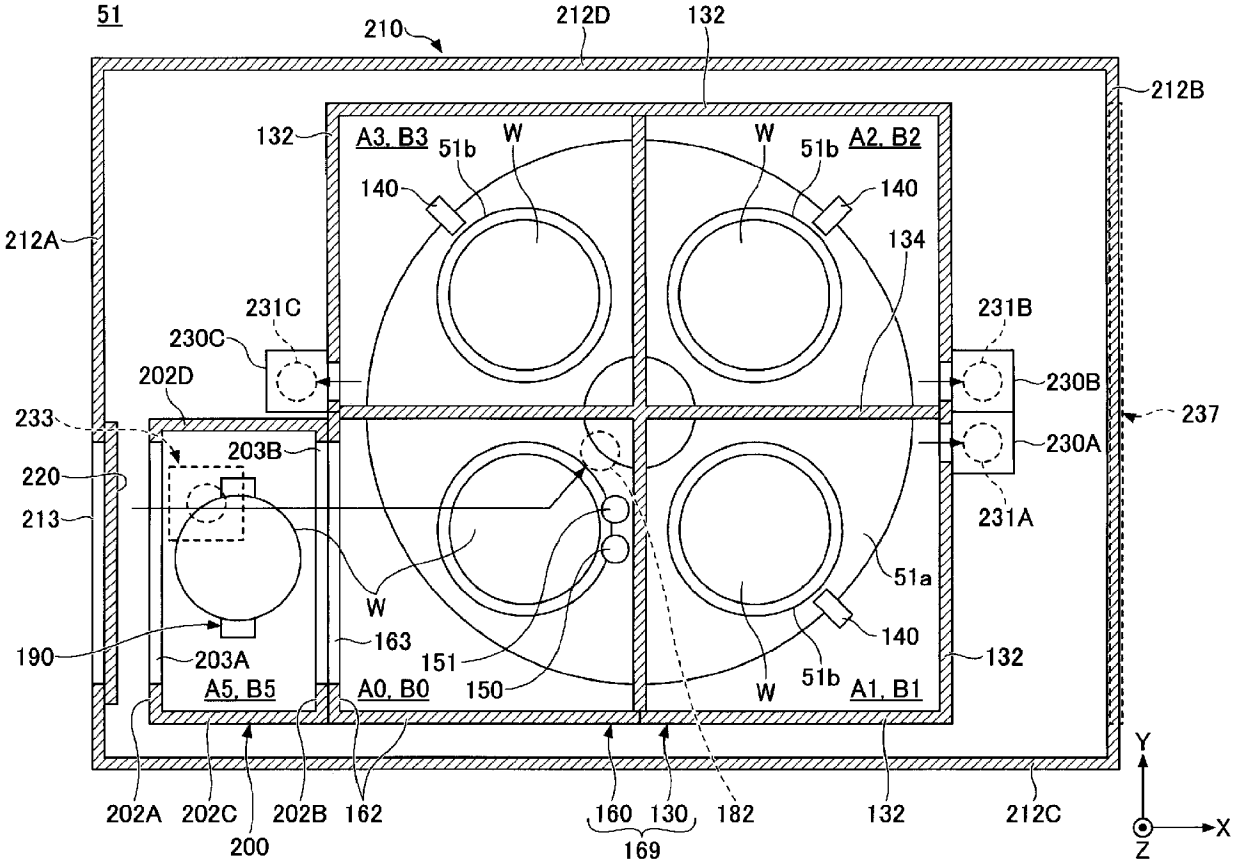
FIG. 9 is a plan view illustrating a gas flow within a housing according to the modification example.

As shown in FIG. 9, the grinding apparatus 51 has a fixed partition wall 134 that partitions the inside of the inner housing 169 into a plurality of rooms around the rotation center line R1 of the rotary table 51*a*. The fixed partition wall 134 is fixed to a bottom surface of a top panel of the inner housing 169. When viewed from above, the fixed partition wall 134 extends in a diametrical direction (that is, a direction orthogonal to the rotation center line R1) of the rotary table 51*a*.

The fixed partition wall 134 is provided in, for example, a cross shape, and divides the inside of the inner housing 169 into four rooms B0 to B3 around the rotation center line R1 of the rotary table 51*a*. The three rooms B1 to B3 are grinding chambers in which the grinding of the substrate W is performed. The room B1 is a first grinding chamber; B2, a second grinding chamber; and B3, a third grinding chamber. The remaining one room B0 is an attachment/detachment chamber in which the attachment/detachment of the substrate W to/from the chuck 51*b* is performed.

When viewed from above, the inside of the inner housing 169 is partitioned into the attachment/detachment chamber B0, the first grinding chamber B1, the second grinding chamber B2, and the third grinding chamber B3 in this order in a counterclockwise direction. Here, the order of the four rooms B0 to B3 may be reversed, so when viewed from above, the inside of the inner housing 169 may be partitioned into the attachment/detachment chamber B0, the first grinding chamber B1, the second grinding chamber B2, and the third grinding chamber B3 in this order in a clockwise direction.

As depicted in FIG. 7, the grinding position cover 130 has the top panel 131 and the side panel 132. The top panel 131 covers the chuck 51*b* from above. The insertion opening 133 of the movable unit 110 is formed in the top panel 131. The top panel 131 has a shape in which a corner of a rectangular is notched. At the notched position, the rectangle-shaped top panel 161 of the attachment/detachment position cover 160 is disposed.

The attachment/detachment position cover 160 also has the top panel 161 and the side panel 162. The top panel 161 covers the attachment/detachment chamber B0 from above. As compared to a configuration in which there is no top panel 161, that is, a configuration in which the top of the attachment/detachment chamber B0 is open, it is possible to suppress the mist and the particles from being upwardly flown out from the attachment/detachment chamber B0.

The top panel 161 of the attachment/detachment position cover 160 is disposed on a level with the top panel 131 of the grinding position cover 130 to be continuous with it. However, since the top panel 161 of the attachment/detachment position cover 160 is separated from the top panel 131 of the grinding position cover 130, it can be removed. If the top panel 161 is removed, the attachment/detachment chamber B0 can be opened, so that the workability of maintenance can be improved.

Meanwhile, the side panel 162 of the attachment/detachment position cover 160 is continuous with the side panel 132 of the grinding position cover 130 (see FIG. 9). The side panel 162 of the attachment/detachment position cover 160 and the side panel 132 of the grinding position cover 130 may be integrated as one body by welding or the like, or may be configured to be inseparable.

At the first grinding position A1, the second grinding position A2, and the third grinding position A3, the grinding of the substrate W is performed. Thus, the top panel 131 of the grinding position cover 130 is formed of, for example, a metal. The metal is excellent in durability because it is difficult for the metal to be damaged by being collided with the grinding debris. The side panels 132 of the grinding position cover 130 is also formed of, for example, a metal. The metal is opaque.

Meanwhile, at the attachment/detachment position A0, the grinding of the substrate W is not performed. Thus, the top panel 161 of the attachment/detachment position cover 160 is made of, by way of non-limiting example, a resin. While the resin is inferior to the metal in durability, it is excellent in see-through property. If the top panel 161 is transparent, the top surface of the chuck 51*b* can be visually observed from above the top panel 161.

Further, the side panel 162 of the attachment/detachment position cover 160 is formed of, for example, a metal, the same as the side panel 132 of the grinding position cover 130. However, the side panel 162 of the attachment/detachment position cover 160 may be formed of a resin and be transparent, the same as the top panel 161.

At the attachment/detachment position A0, the cleaning of the chuck 51*b* or the substrate W is performed, unlike at the first grinding position A1 and so forth. As a result, droplets of the cleaning liquid may be scattered and adhere to the bottom surface of the top panel 161 of the attachment/detachment position cover 160. The attached droplets contain the particles such as grinding debris.

Figure 8:
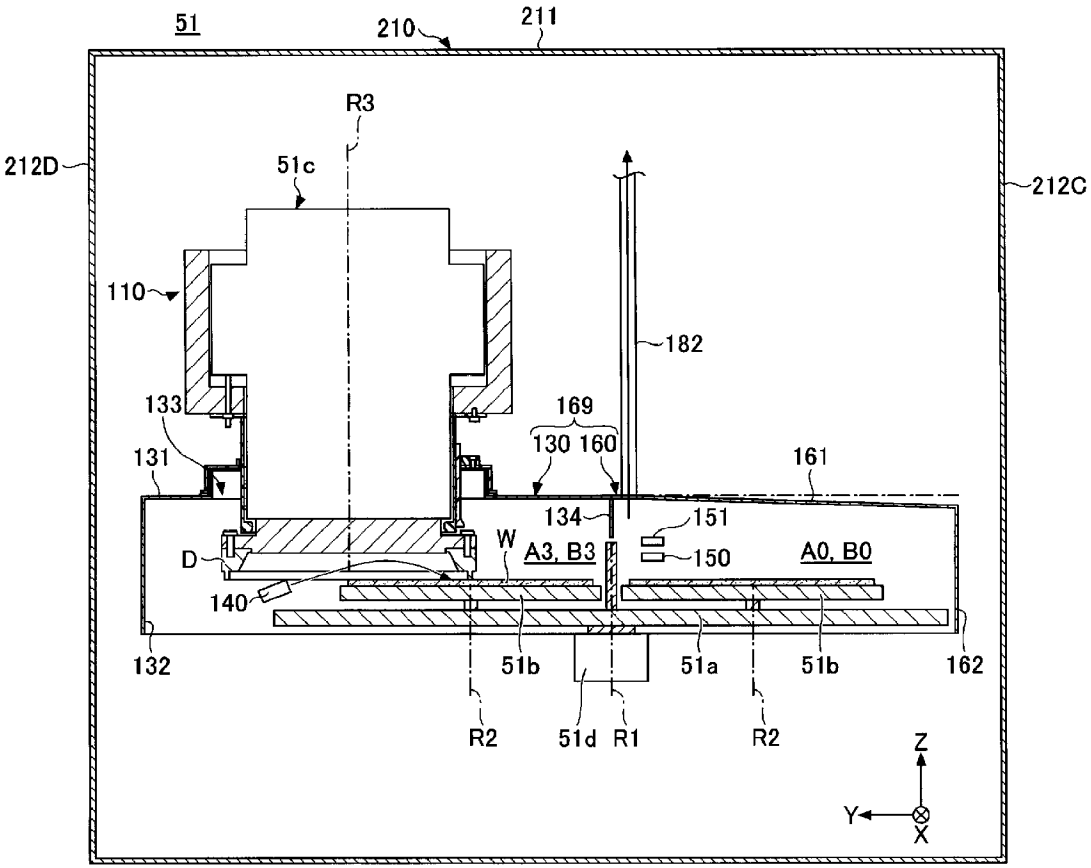
FIG. 8 is a cross sectional view perpendicular to the X-axis direction of the grinding apparatus according to the modification example.

As shown in FIG. 8, the bottom surface of the top panel 161 of the attachment/detachment position cover 160 may be inclined obliquely downwards. For example, the bottom surface of the top panel 161 is inclined downwards as it goes away from the fixed partition wall 134 which is a boundary between the attachment/detachment chamber B0 and the third grinding chamber B3. Due to this inclination, the droplets flow obliquely downwards in the state that they are attached to the bottom surface of the top panel 161. Accordingly, the droplets can be suppressed from falling onto the attraction surface of the chuck 51*b*, so that contamination of the attraction surface can be suppressed. Since the substrate W can be disposed on the clean attracting surface, the particles can be suppressed from being mixed therein. Therefore, since the substrate W can be ground flat, the deterioration of the thickness variation (TTV: Total Thickness Variation) of the substrate W can be suppressed.

As illustrated in FIG. 7, the grinding apparatus 51 may have an exhaust unit 182 on the attachment/detachment position cover 160. The exhaust unit 182 includes a duct. The duct of the exhaust unit 182 extends to the outside of the grinding apparatus 51, and is connected to a non-illustrated suction source. The suction source is, for example, a vacuum pump or an ejector. The suction source may be a part of factory equipment. The exhaust unit 182 is configured to exhaust a gas from the inside of the attachment/detachment position cover 160 by a suction force of the suction source. A damper configured to adjust an exhaust amount of the gas may be provided at a portion of the duct of the exhaust unit 182.

The exhaust unit 182 exhausts the gas flowing into the attachment/detachment position cover 160 from the transfer opening 163 of the attachment/detachment position cover 160 to a space above the attachment/detachment position cover 160. The exhaust unit 182 discharges the mist and the particles along with the gas to suppress scattering of the mist and the particles. Further, the exhaust unit 182 forms a one-way flow of the gas in the transfer opening 163 of the inner housing 169, thus suppressing the outflow of the particles. In addition, the exhaust unit 182 forms an ascending airflow in the attachment/detachment chamber B0 to thereby suppress the drop of the droplets or the particles adhering to the bottom surface of the top panel 161.

As shown in FIG. 9, the grinding apparatus 51 may be equipped with the bottom surface cleaning mechanism 190 and a cleaning cover 200. The bottom surface cleaning mechanism 190 cleans, at a cleaning position A5 next to the attachment/detachment position A0, the bottom surface of the substrate W after being ground which has been detached from the chuck 51*b*. The cleaning cover 200 is provided adjacent to the attachment/detachment position cover 160 and accommodates therein the bottom surface cleaning mechanism 190. The cleaning cover 200 forms a cleaning chamber B5 therein.

The cleaning cover 200 has a top panel 201 and four side panels 202A, 202B, 202C and 202D. The top panel 201 covers the bottom surface cleaning mechanism 190 from above. The top panel 201 is disposed horizontally, for example. Meanwhile, the side panels 202A, 202B, 202C and 202D cover the bottom surface cleaning mechanism 190 from the side. The side panels 202A, 2026, 202C and 202D are arranged vertically, for example. A non-illustrated cleaning pan is disposed below the bottom surface cleaning mechanism 190. The cleaning pan collects a cleaning liquid or the like. The cleaning cover 200 suppresses the cleaning liquid from being scattered to the outside.

The cleaning cover 200 partitions the attachment/detachment position A0 and the cleaning position A5. Specifically, the side panel 202B of the cleaning cover 200 partitions the attachment/detachment position A0 and the cleaning position A5. With this configuration, the mist and the particles can be suppressed from being moved from the attachment/detachment position A0 to the cleaning position A5. Further, the side panel 162 of the attachment/detachment position cover 160 also partitions the attachment/detachment position A0 and the cleaning position A5.

The grinding apparatus 51 has an outer housing 210 that forms an outermost surface of the grinding apparatus 51. The outer housing 210 accommodates therein the grinding position cover 130, the attachment/detachment position cover 160, the cleaning cover 200 and the grinding unit 51*c*. The outer housing 210 has a top panel 211 and four side panels 212A, 2126, 212C and 212D. The top panel 211 is disposed horizontally. Meanwhile, the side panels 212A, 2126, 212C and 212D are disposed vertically. The outer housing 210 may include a non-illustrated frame. The frame includes a column, a beam, and so forth.

As illustrated in FIG. 9, the outer housing 210 includes a transfer opening 213 for the substrate W in its side surface. The transfer opening 213 is formed in the side panel 212A. The cleaning cover 200 includes, on a straight line connecting the transfer opening 213 of the outer housing 210 and the transfer opening 163 of the attachment/detachment position cover 160, openings 203A and 203B through which the substrate W and the gas pass. By arranging these transfer openings 213, 203A, 203B and 163 on the straight line, the transfer of the substrate W and the flow of the gas become easy.

The grinding apparatus 51 further includes a shutter 220 configured to open or close the transfer opening 213 of the outer housing 210. The shutter 220 basically closes the transfer opening 213, and opens the transfer opening 213 when the substrate W passes. As compared to a case where the transfer opening 213 is always opened, it is possible to suppress the mist and the particles from being flown out form the grinding section 5 into the cleaning section 3 through the transfer opening 213, so that the cleanliness of the cleaning section 3 can be further improved.

While the shutter 220 opens the transfer opening 213 of the outer housing 210, the gas flows into the attachment/detachment position cover 160 through the transfer opening 213 of the outer housing 210, the openings 203A and 203B of the cleaning cover 200, and the transfer opening 163 of the attachment/detachment position cover 160. Since this gas flow is one-way, the outflow of the particles can be suppressed. However, this gas flow is blocked when the shutter 220 closes the transfer opening 213 of the outer housing 210.

Accordingly, as illustrated in FIG. 7, a gap G is formed between the transfer opening 213 of the outer housing 210 and the opening 203A of the cleaning cover 200. The gap G forms a passage for the gas that flows from the outside of the cleaning cover 200 to the opening 203A of the cleaning cover 200. Even if the shutter 220 closes the transfer opening 213 of the outer housing 210, a required gas flow is formed. The gas flows into the attachment/detachment position cover 160 through the openings 203A and 203B of the cleaning cover 200 and the transfer opening 163 of the attachment/detachment position cover 160.

As depicted in FIG. 9, the grinding apparatus 51 is equipped with, near the side panel 132 of the grinding position cover 130, exhaust boxes 230A, 230B and 230C configured to exhaust the gas. The exhaust boxes 230A, 230B, and 230C are connected to exhaust ducts 231A, 231B, and 231C. The exhaust ducts 231A, 231B, and 231C extend to the outside of the grinding apparatus 51, and are connected to a suction source. The suction source is, for example, a vacuum pump or an ejector. The suction source may be a part of factory equipment. A damper configured to adjust an exhaust amount may be provided at a portion of the exhaust ducts 231A, 231B, and 231C.

The exhaust box 230A exhausts the gas from the first grinding chamber B1 by a suction force of the suction source. Further, the exhaust box 230B exhaust the gas from the second grinding chamber B2 by the suction force of the suction source. Furthermore, the exhaust box 230C exhausts the gas from the third grinding chamber B3 by the suction force of the suction source. With this configuration, it is possible to suppress the mist and the particles from being moved between the attachment/detachment chamber B0, the first grinding chamber B1, the second grinding chamber B2, and the third grinding chamber B3.

As shown in FIG. 7, the grinding apparatus 51 is equipped with an exhaust unit 233. The exhaust unit 233 includes an exhaust opening 234 at an outside of the inner housing 169 as an inside of the outer housing 210, and exhausts the gas from the exhaust opening 234 to the outside of the outer housing 210. The exhaust unit 233 includes, for example, a duct 235. The exhaust opening 234 is provided at one end of the duct 235. The other end of the duct 235 is connected to a suction source. The suction source is, for example, a vacuum pump or an ejector. The suction source may be a part of factory equipment. A damper configured to adjust an exhaust amount may be provided at a portion of the duct 235.

The suction source may be shared by a plurality of ducts (for example, the duct 235 of the exhaust unit 233, the duct of the exhaust unit 182, and the exhaust ducts 231A, 2318 and 231C). These ducts join each other on the way and are connected to the common suction source. A balance in the exhaust amounts of the plurality of ducts is adjusted by the dampers.

The exhaust unit 233 exhausts the gas from the exhaust opening 234 inside the outer housing 210 to the outside of the outer housing 210 by the suction force of the suction source. The exhaust unit 233 exhausts, together with the gas, the particles and the mist leaking from the inner housing 169 and the heat generated during the operation of the grinding unit 51*c* or the like. Accordingly, it is possible to keep the inside of the outer housing 210 clean, and, furthermore, it is possible to maintain clean a clean room in which the grinding apparatus 51 is provided. In addition, since accumulation of the heat within the outer housing 210 can be suppressed, a temperature rise can be suppressed.

The exhaust opening 234 of the exhaust unit 233 faces the side panel 212B of the outer housing 210 and is formed to be obliquely downward. The side panel 212B is provided with an intake opening 238 to be described later. The intake opening 238 sucks in the gas from the outside of the outer housing 210. Since the exhaust opening 234 faces the intake opening 238, the gas can be efficiently sucked in through the intake opening 238, and the gas can be efficiently exhausted through the exhaust opening 234. Moreover, since the exhaust opening 234 also faces downwards, the gas can be exhausted efficiently through a space underneath as well.

The exhaust unit 233 may include a baffle plate 236 in the exhaust opening 234. The baffle plate 236 is, by way of non-limiting example, a punched metal. The punched metal has a plurality of round holes in a metal plate. The holes of the baffle plate 236 are not limited to the round holes, but they may be polygonal holes such as triangular holes, square holes, or hexagonal holes. The baffle plate 236 enables to exhaust the gas efficiently from a required direction.

As illustrated in FIG. 7, the grinding apparatus 51 includes a gas supply unit 237. The gas supply unit 237 supplies a gas from the outside of the outer housing 210 to the inside thereof. The gas supply unit 237 and the exhaust unit 233 face each other with the grinding unit 51*c* therebetween. The gas absorbs the heat of the grinding unit 51*c* on the way from the gas supply unit 237 to the exhaust unit 233. Therefore, the heat of the grinding unit 51*c* can be discharged efficiently.

The gas supply unit 237 includes the intake opening 238 provided in the side panel 212B of the outer housing 210. If the exhaust unit 233 exhausts the gas from the inside of the outer housing 210 to the outside thereof and the inside of the outer housing 210 is turned into a negative pressure, the exterior air is automatically sucked in from the outside of the outer housing 210 to the inside thereof through the intake opening 238. Since a pump or the like is unnecessary, the mechanism of the gas supply unit 237 can be simplified.

The gas supply unit 237 has, at an outside of the outer housing 210, a hood 239 covering the intake opening 238. The hood 239 is opened only downwards, and the top and the side thereof are closed. The intake opening 238 sucks in the exterior air from below the hood 239. Therefore, intake of particles can be suppressed by using gravity.

As shown in FIG. 9, the outer housing 210 includes two side panels 212A and 2126 facing each other. The intake opening 238 is formed in the side panel 2126, and the transfer opening 213 for the substrate W is formed in the side panel 212A. The exhaust unit 233 is provided in the vicinity of the side panel 212A. When viewed from above, the exhaust unit 233 is provided between the side panel 212A and the inner housing 169. By way of example, the exhaust unit 233 is disposed directly above the cleaning cover 200.

So far, the grinding apparatus according to the present disclosure has been described. However, the present disclosure is not limited to the above-described exemplary embodiment and the like. Various changes, modifications, substitutions, additions, deletions and combinations may be made within the scope of the claims, which are all incorporated within a technical scope of the present disclosure.

This application claims priority to Japanese Patent Application No. 2020-038617 field on Mar. 6, 2020 and Japanese Patent Application No. 2020-196353 filed on Nov. 26, 2020, which applications are hereby incorporated by reference in their entirety.

According to the exemplary embodiments, it is possible to suppress the outflow of the particles and the mist generated in the grinding apparatus.

I claim:

1. A grinding apparatus, comprising:

a horizontal rotary table configured to be rotated around a vertical rotation center line;

multiple chucks arranged at an equal distance therebetween around the vertical rotation center line of the horizontal rotary table;

a rotational driving unit configured to rotate the horizontal rotary table to move the chuck between an attachment/detachment position where attachment/detachment of a substrate to/from the chuck is performed and a grinding position where grinding of the substrate placed on the chuck is performed;

a grinding position cover including a side panel disposed vertically, and a partition wall that extends vertically upward from a position above the horizontal rotary table, the grinding position cover covering the grinding position from above and from a side, thereby forming a grinding chamber within the grinding position cover;

a cleaning unit configured to supply a cleaning liquid to the chuck or the substrate at the attachment/detachment position;

an attachment/detachment position cover covering the attachment/detachment position from above and from a side; and an outer housing accommodating therein the grinding position cover and the attachment/detachment position cover, wherein the attachment/detachment position cover is provided with a transfer opening for the substrate in a side surface thereof, and accommodates therein the chuck and the cleaning unit, wherein the attachment/detachment position cover comprises:

a top panel covering the chuck from above; and a side panel disposed vertically at a side of the top panel and including the transfer opening formed therein, and wherein the side panel of the attachment/detachment position cover is continuous with the side panel of the grinding position cover.

2. The grinding apparatus of claim 1, further comprising:

a shutter configured to open or close the transfer opening of the attachment/detachment position cover.

3. The grinding apparatus of claim 1, further comprising:

a gas supply nozzle provided within the attachment/detachment position cover, and configured to discharge a gas to the substrate from above before the substrate is carried out from the transfer opening.

4. The grinding apparatus of claim 1, wherein a height of a ceiling of the attachment/detachment position cover is higher than a height of a ceiling of the grinding position cover.

5. The grinding apparatus of claim 1, further comprising:

a gas supply unit provided at a ceiling of the attachment/detachment position cover, and configured to form a downflow within the attachment/detachment position cover.

6. The grinding apparatus of claim 1, further comprising:

an exhaust unit configured to exhaust a gas within the attachment/detachment position cover in a direction opposite to the grinding position cover.

7. The grinding apparatus of claim 1, further comprising:

a bottom surface cleaning device provided next to the attachment/detachment position, and configured to clean a bottom surface of the substrate after being ground and detached from the chuck, wherein the attachment/detachment position cover further covers the bottom surface cleaning device from above and from a side.

8. The grinding apparatus of claim 1, further comprising:

an exhaust unit on the attachment/detachment position cover, wherein the exhaust unit is configured to exhaust a gas flowing into the attachment/detachment position cover from the transfer opening of the attachment/detachment position cover to a space above the attachment/detachment position cover.

9. The grinding apparatus of claim 8, further comprising:

a bottom surface cleaning device configured to clean, at a cleaning position next to the attachment/detachment position, a bottom surface of the substrate after being ground and detached from the chuck; and a cleaning cover provided adjacent to the attachment/detachment position cover, the cleaning cover accommodating therein the bottom surface cleaning device, wherein the cleaning cover partitions the attachment/detachment position and the cleaning position.

10. The grinding apparatus of claim 9, wherein the outer housing further accommodates therein the cleaning cover, wherein the outer housing is provided with a transfer opening for the substrate in a side surface thereof, and wherein the cleaning cover is provided with, on a straight line connecting the transfer opening of the outer housing and the transfer opening of the attachment/detachment position cover, an opening through which the substrate and the gas pass.

11. The grinding apparatus of claim 10, further comprising:

a shutter configured to open or close the transfer opening of the outer housing.

12. The grinding apparatus of claim 11, wherein a gap is formed between the transfer opening of the outer housing and the opening of the cleaning cover, and the gap forms a passage through which the gas flowing from an outside of the cleaning cover toward the opening of the cleaning cover passes.

13. The grinding apparatus of claim 1, wherein the top panel is transparent.

14. The grinding apparatus of claim 1, wherein a bottom surface of the top panel is inclined obliquely downwards.

15. The grinding apparatus of claim 1, wherein a rotary partition wall is provided on a top surface of the horizontal rotary table and forms the grinding chamber together with the grinding position cover.

16. The grinding apparatus of claim 1, wherein the grinding position cover further includes a top panel disposed horizontally, and the top panel of the attachment/detachment position cover is disposed at a level with the top panel of the grinding position cover to be continuous with the top panel of the grinding position cover.

17. A grinding apparatus, comprising:

a horizontal rotary table configured to be rotated around a vertical rotation center line;

multiple chucks arranged at an equal distance therebetween around the vertical rotation center line of the horizontal rotary table;

a rotational driving unit configured to rotate the horizontal rotary table to move the chuck between an attachment/detachment position where attachment/detachment of a substrate to/from the chuck is performed and a grinding position where grinding of the substrate placed on the chuck is performed;

a grinding position cover including a side panel disposed vertically, and covering the grinding position from above and from a side;

a cleaning unit configured to supply a cleaning liquid to the chuck or the substrate at the attachment/detachment position;

an attachment/detachment position cover covering the attachment/detachment position from above and from a side; and an outer housing accommodating therein the grinding position cover and the attachment/detachment position cover, wherein the attachment/detachment position cover is provided with a transfer opening for the substrate in a side surface thereof, and accommodates therein the chuck and the cleaning unit, wherein a rotary partition wall is provided on a top surface of the horizontal rotary table and forms a grinding chamber together with the grinding position cover, wherein the attachment/detachment position cover comprises:

a top panel covering the chuck from above; and a side panel disposed vertically at a side of the top panel and including the transfer opening formed therein, and wherein the side panel of the attachment/detachment position cover is continuous with the side panel of the grinding position cover.

* * * * *